US006755668B2

(12) United States Patent
Copper et al.

(10) Patent No.: US 6,755,668 B2
(45) Date of Patent: Jun. 29, 2004

(54) SURFACE MOUNTED SOCKET ASSEMBLY

(75) Inventors: Charles Dudley Copper, Harrisburg, PA (US); Craig Maurice Campbell, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/300,259

(22) Filed: Nov. 20, 2002

(65) Prior Publication Data

US 2004/0097108 A1 May 20, 2004

(51) Int. Cl.[7] ..... H01R 12/00; H05K 1/00
(52) U.S. Cl. ..... 439/83; 439/73; 439/264
(58) Field of Search ..... 439/83, 73, 264, 439/331

(56) References Cited

U.S. PATENT DOCUMENTS 5,793,618 A * 8/1998 Chan et al. ..... 361/809
5,829,988 A * 11/1998 McMillan et al. ..... 439/70
5,876,219 A * 3/1999 Taylor et al. ..... 439/74
5,892,245 A * 4/1999 Hilton ..... 257/48
6,155,848 A 12/2000 Lin ..... 439/135
6,164,983 A * 12/2000 Lemke et al. ..... 439/83
6,220,884 B1 4/2001 Lin ..... 439/342
6,231,367 B1 * 5/2001 Hsiao et al. ..... 439/342
6,394,820 B1 * 5/2002 Palaniappa et al. ..... 439/83
6,425,771 B1 * 7/2002 Shirai et al. ..... 439/83

* cited by examiner

*Primary Examiner*—Michael C. Zarroli

(57) ABSTRACT

A socket assembly configured to be reflow soldered to a circuit board comprising a perimeter frame having a central open area surrounded by perimeter walls. The socket assembly may be configured to be surface mounted on a circuit board, wherein at least one of the perimeter walls includes a post extending downward therefrom. The socket assembly also comprises a base fit into the open area of the perimeter frame. The base is separate and distinct from the socket frame. The base has a post hole therein positioned to mate with the post. Additionally, the socket assembly comprises contacts held by the base, and solder balls provided on a bottom of the base. The solder balls engage the contacts and, prior to, and after, soldering, extend beyond a bottom of the socket frame.

20 Claims, 6 Drawing Sheets

SURFACE MOUNTED SOCKET ASSEMBLY

BACKGROUND OF THE INVENTION

The present invention generally relates to a separable interface connector, and more particularly relates to a separable interface connector that joins a printed circuit board through reflow soldering to an electrical component, such as a motherboard.

Various electronic systems, such as computers, comprise a wide array of components mounted on printed circuit boards, such as daughterboards and motherboards, which are interconnected to transfer signals and power throughout the system. The transfer of signals and power between the circuit boards requires electrical interconnection between the circuit boards.

Certain interconnections include a socket assembly and a plug assembly, or integrated circuit (IC) chip. Some socket assemblies include spring contacts, which are configured to mate with conductive pads on the plug assembly. As the socket assembly and plug assembly mate, the spring contacts exert a normal force on the contact pads, thus ensuring proper electrical contact between the spring contacts and the conductive pads.

In order to establish adequate contact, the spring contacts wipe across the conductive pads, cleaning both surfaces, as the plug assembly is mated into the socket assembly. Typically, during mating, the spring contacts are deflected. During deflection, the spring contacts exert a resistive force on the plug assembly. The resistive force typically has normal and tangential components. The normal force is usually referred to as the contact force and the tangential force is usually caused by the frictional behavior of the wiping motion.

Typical socket assemblies, whether pin grid array (PGA), land grid array (LGA), or ball grid array (BGA) assemblies, are soldered to an electrical component, such as a motherboard. Typically, solder balls are attached to the bottom of the socket assembly. The socket assembly is positioned on a motherboard, and both components are passed through an oven, or other heating device, to begin the solder reflow process. During the solder reflow process, the solder balls melt and form a cohesive layer between the socket assembly and the motherboard. The solder layer cools after the heating and forms an electrically conductive bond between the socket assembly and the motherboard.

Some socket assemblies are soldered to motherboards such that the solder layer is the only intervening material that supports and extends between the socket assembly and the motherboard. That is, the socket assembly does not contact the motherboard at any other point during or after the solder reflow process. When the plug assembly is mated into the socket assembly, however, the mating or clamping force exerted into the socket assembly is fully translated to, and absorbed by, the solder layer. The solder layer may be further collapsed, disrupted or otherwise compressed due to the forces absorbed. Consequently, the electrical connection between the socket assembly and the motherboard may be adversely affected.

In order to counter the effects of mating or clamping forces being exerted into the solder layer, some socket assemblies include standoffs that support and stabilize the socket assembly onto the motherboard. Typically, the standoffs extend a distance that is less than that of the solder balls, but more than that of the natural reflow height of the solder balls. That is, before the solder reflow process, the standoffs do not touch the motherboard. When the socket assembly is soldered to the motherboard, the height of the socket assembly from the motherboard is dictated by the standoffs. U.S. Pat. No. 6,155,848, issued to Lin ("the '848 patent"), describes an auxiliary device for a ZIF electrical connector that uses standoffs. The '848 patent discloses that the height of the stand-off portion is less than the height of the solder balls before soldering, and equal to the height of the solder balls after soldering. Thus, after the solder reflow process, the resulting solder layer is dictated by the height of the standoffs. U.S. Pat. No. 6,220,884, issued to Lin ("the '884 patent") discloses a BGA socket that comprises an insulative cover supported by standoffs on a base. The standoffs of the cover extend beyond a bottom surface of the base. After the solder reflow process, the resulting solder layer is dictated by the height of the standoffs.

Additionally, in both the '848 and '884 patents, the components (such as IC chips) that mate with each socket include pins. That is, the IC chips include pins that are mated into the socket. The existence of pins on the IC chips mandates that the height of the sockets is adequate to receive and retain the pins.

However, conventional socket assemblies, including those of the '848 and '884 patents, do not allow the solder balls to reflow to the height they naturally would if there were no components that interfered. That is, the solder balls do not melt to a natural reflow height. Rather, the height of the resulting solder layer is dictated by the height of the standoffs. Because the solder layer is not necessarily at its natural height, electrical transmission through the solder layer may be adversely affected. For example, the solder layer may be too dense or too sparse due to the fact that the standoffs dictate the height of the solder layer.

Thus, a need exists for a socket assembly that may be reflow soldered to an electrical component more efficiently, and in a manner that ensures a better conductive path through the resulting solder layer.

BRIEF SUMMARY OF THE INVENTION

Certain embodiments of the present invention provide a socket assembly configured to be reflow soldered to a circuit board. The socket assembly comprises a socket frame, or perimeter frame, having a central open area surrounded by perimeter walls. The socket assembly may be configured to be surface mounted on a circuit board, wherein at least one of the perimeter walls includes a post extending downward therefrom. The socket assembly also comprises a socket board, or base, fit into the open area of the socket frame. The socket board is separate and distinct from the socket frame. Optionally, the socket frame may be integrally formed with the socket board as a single unit during manufacture. During assembly, the socket frame may then separate, or break away, from the socket board by way of a separation zone, such as a perforated area between the socket frame and the socket board.

The socket board has a post hole therein positioned to mate with the post. Additionally, the socket assembly comprises contacts held by the socket board, and solder balls provided on a bottom surface of the socket board. The solder balls engage the contacts and, prior to, and after, soldering, extend beyond a bottom of the socket frame.

The post is held partially seated in the post hole when the socket board and frame are positioned in a pre-soldered state. The post becomes fully seated in the post hole when the socket board and frame move during a plug assembly mating state, that is, when a plug assembly is mated into the socket assembly. The assembly process is controlled in that, after the reflow process, the post is able to move through the post hole in a mating direction defined by the direction of the plug assembly moving into the socket assembly.

Figure 1:
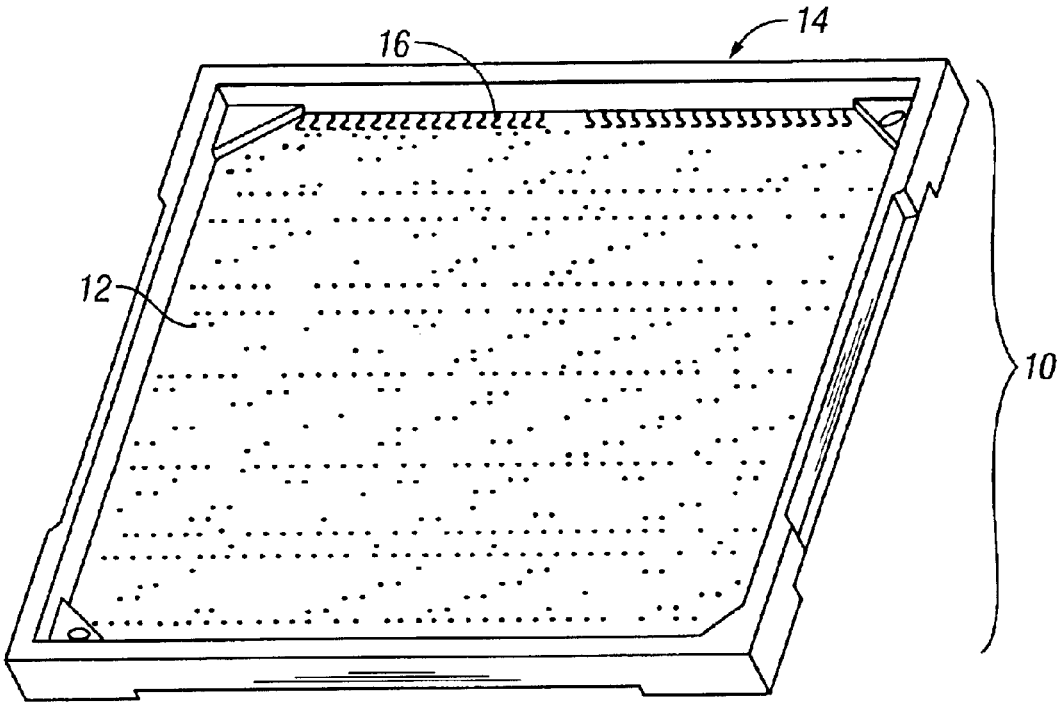
FIG. 1 is an isometric view of a socket assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 is an isometric view of a socket assembly 10 formed in accordance with an embodiment of the present invention. The socket assembly 10 is a two-piece, assembly that includes a socket board 12 and a socket frame 14. The socket board 12 includes a plurality of spring contacts 16 mounted thereon. For the sake of simplicity, only one row of spring contacts 16 is shown in FIG. 1. The socket assembly 10 may be a Ball Grid Array (BGA) assembly.

The socket board 12 and socket frame 14 are separate and distinct components. The socket board 12 connects to the perimeter frame by the mating, engagement or otherwise interaction of posts 26 (discussed below) of the socket frame 14 with post cavities 34 (discussed below) of the socket board 12. The socket board 12 forms the base of the socket assembly 10.

Figure 2:
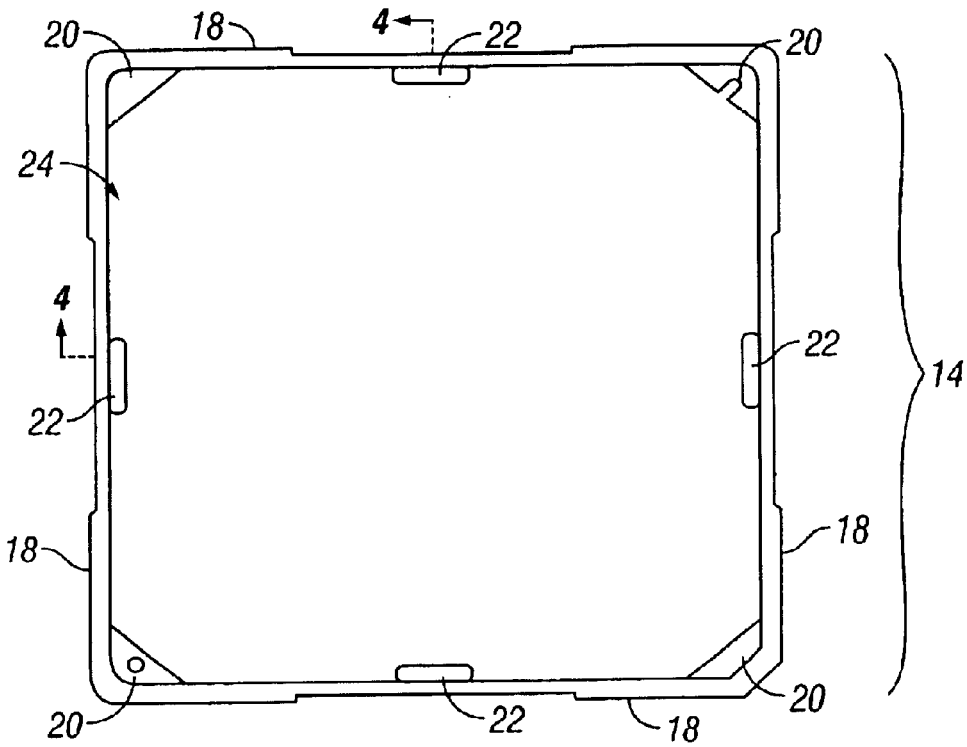
FIG. 2 is a top view of a socket frame of a socket assembly according to an embodiment of the present invention.

FIG. 2 is a top view of the socket frame 14 of the socket assembly 10. The socket frame 14 includes perimeter walls 18 having corners 20, midsections 22 and an opening 24 defined between the perimeter walls 18.

Figure 3:
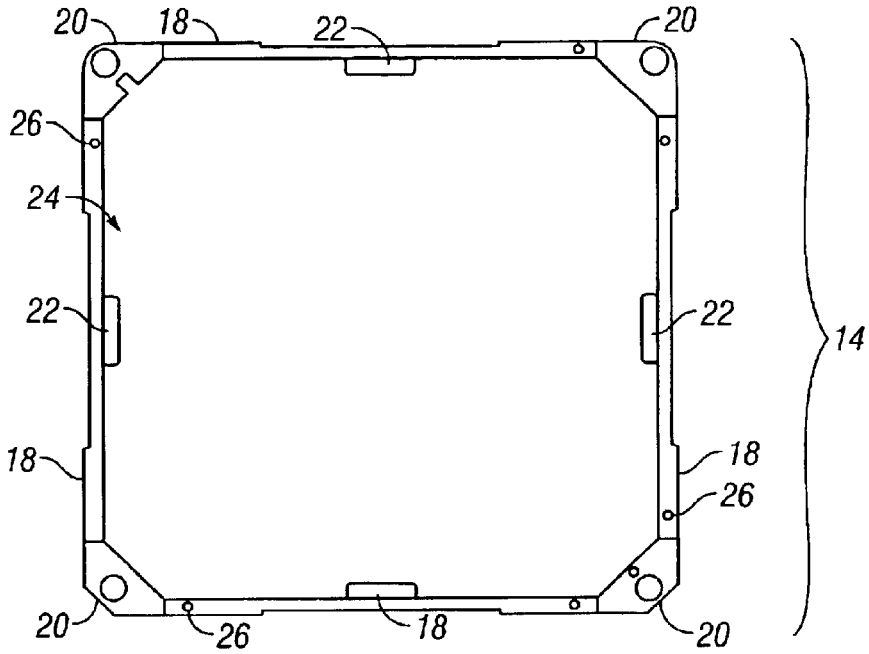
FIG. 3 is a bottom view of a socket frame according to an embodiment of the present invention.

FIG. 3 is a bottom view of the socket frame. The socket frame 14 also includes posts 26, which extend downwardly from the bottom surface of the perimeter walls 18. While five posts 26 are shown, more or less posts 26 may be formed on the perimeter walls 18.

Figure 4:
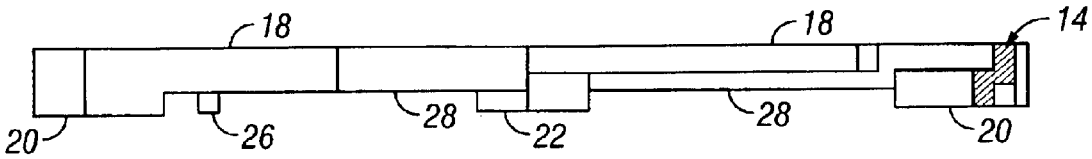
FIG. 4 is a cross-sectional view of a socket frame through line 4—4 of FIG. 2 according to an embodiment of the present invention.

FIG. 4 is a cross-sectional view of the socket frame 14 through line 4—4 of FIG. 2. The socket frame 14 also includes recesses 28 formed in the perimeter walls 18 between the corners 20 and the midsections 22. The recesses 28 are formed so that the socket frame 14 may fit together with the socket board 12. As shown in FIG. 4, the posts 26 extend downwardly from the bottom surface of the perimeter walls 18. The posts 26 do not extend beyond the plane defined by the bottom surfaces of the corners 20 and midsections 22. Alternatively, the posts 26 may extend beyond the plane defined by the bottom surfaces of the corners 20 and midsections 22.

Figure 5:
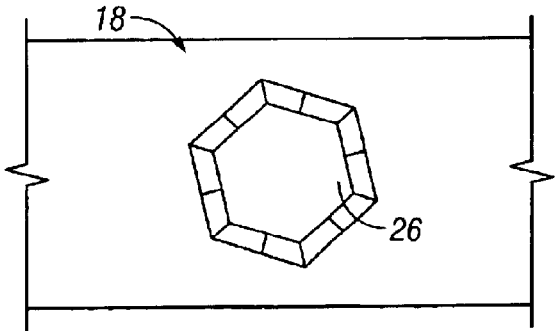
FIG. 5 is a bottom view of a post according to an embodiment of the present invention.

FIG. 5 is a bottom view of a post 26. The post 26 is hexagonal, but may be any shape that provides an adequate interference fit with a post hole or cavity formed in the socket board 12. For example, the posts 26 may be formed as octagons, squares, triangles, circles, etc.

Figure 6:
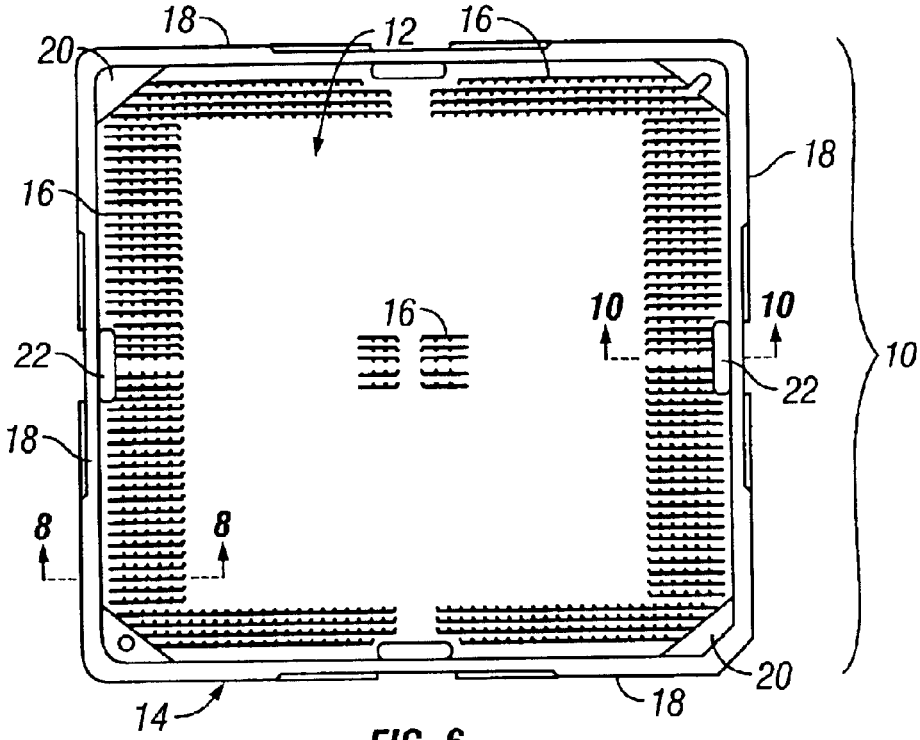
FIG. 6 is a top view of a socket assembly according to an embodiment of the present invention.

FIG. 6 is a top view of the socket assembly 10. FIG. 6 shows the socket frame 14 and the socket board 12 fitted together. The perimeter walls 18 of the socket frame 14 overlap outer edge 30 (as shown, for example, in FIG. 8) of the socket board 12 when the socket board 12 and the socket frame 14 are fit together. As shown in FIG. 6, a plurality of spring contacts 16 are mounted on the socket board 12, which acts as the base of the socket assembly 10. More or less spring contacts 16 than those shown may be positioned on the socket board 12.

Figure 10:
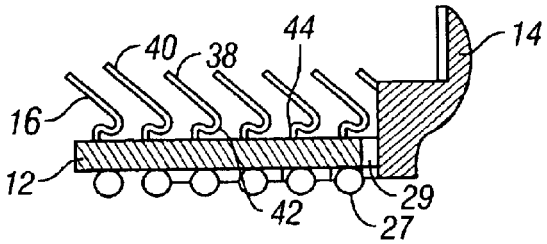
FIG. 10 is a cross-sectional view of a socket assembly through line 10—10 of FIG. 6 according to an embodiment of the present invention.

FIG. 10 is a cross-sectional view of the socket assembly 10 taken through line 10—10 of FIG. 6. Each spring contact 16 includes a wiping tip 38 formed integrally with a deflectable extension portion 40. The deflectable extension portion 40 is formed integrally with a curved transition portion 42, which is in turn formed integrally with a retained portion 44. The retained portion 44 is securely held by a contact cavity formed in the socket board 12 of the socket assembly 10. A terminal end of the retained portion 44 contacts a solder ball 27. As shown in FIG. 10, the socket board 12 is not formed integrally with the socket frame 14. That is, the socket board 12 and the socket frame 14 abut against or are spaced apart from one another at interface 29.

Figure 7:
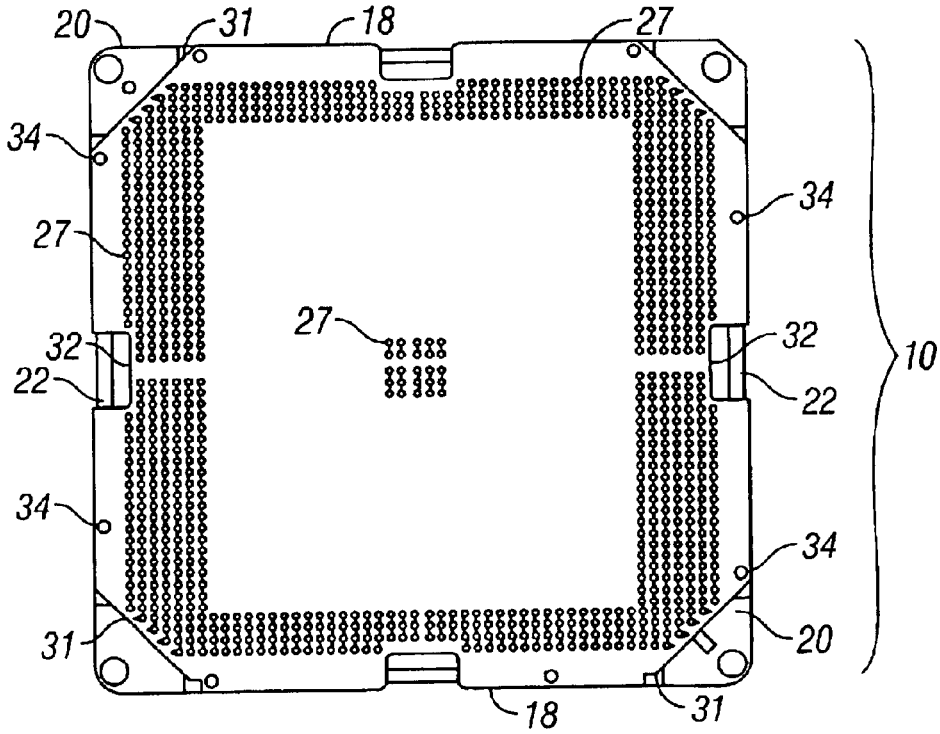
FIG. 7 is a bottom view of a socket assembly according to an embodiment of the present invention.

FIG. 7 is a bottom view of the socket assembly 10 to better illustrate that the socket board 12 is generally formed as a square with chamfered corners 31. Notches 32 are also cut in the sides of the socket board 12. The corners 20 and the midsections 22 extending downward from the socket frame 14 are received by corresponding chamfered corners 31 and notches 32, respectively, in the socket board 12. That is, the socket board 12 and the socket frame 14 fit together through the interaction of corresponding corners and midsections 20 and 22 with chamfered corners and notches 31 and 32, respectively. The socket board 12 also includes post cavities 34 arranged about the perimeter and an array of solder balls 27, which may correspond to the number of spring contacts 16.

Figure 8:
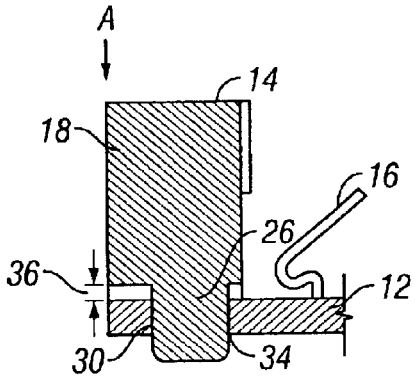
FIG. 8 is a partial cross-sectional view of a socket assembly taken through line 8—8 shown in FIG. 6 according to an embodiment of the present invention.

FIG. 8 is a partial cross-sectional view of the socket assembly 10 through line 8—8 shown in FIG. 6. The post cavities 34 are positioned on the outer edges of the socket board 12 and correspond to positions of the posts 26 located on the socket frame 14. Upon initial mating of the post 26 and the post cavities 34, a clearance area 36 is formed between the socket board 12 and the socket frame 14. When a plug assembly (discussed below) is inserted into the socket assembly 10, the clearance area 36 is either decreased or eliminated. That is, when the plug assembly is mated into the socket assembly 10, the socket frame 14 is pressed toward the socket board 12 along with the plug assembly in the direction of line A until becoming fully seated. The posts 26 and post receptacles 34 are configured so that an interference fit exists between the two when mated. Further, the interference fit is such that additional force in the direction of line A moves the socket frame 14 into the socket board 12. In other words, as shown, for example in FIGS. 8 and 13, the posts 26 of socket frame 14 are mated into the post cavities 34 of the socket board 12 to a pre-plug position (in which the socket assembly 10 does not touch a motherboard or other circuit board to which it is soldered). Also, after the socket assembly 10 is soldered to the board, but before the plug assembly is fully mated with the socket assembly 10, the posts 26 may remain in the same position with respect to the post cavities 34. After the plug assembly is fully mated into the socket assembly 10, as shown for example in FIG. 14, the socket frame 14 is in its fully seated position with respect to the socket board 12 (in which the socket assembly 10 may abut the motherboard or other circuit board to which it is soldered).

Figure 9:
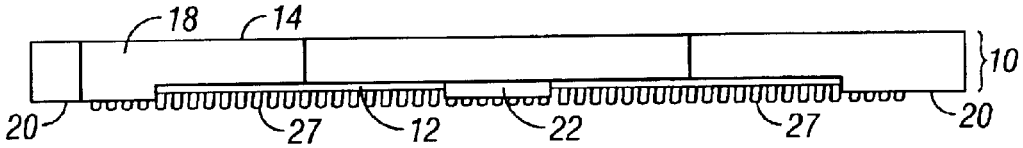
FIG. 9 is a side view of a socket assembly according to an embodiment of the present invention.

FIG. 9 is a side view of the socket assembly 10 before reflow soldering. As shown in FIG. 9, the solder balls 27 extend below the bottom surfaces of the corners 20 and the midsections 22 of the socket frame 14. Because the solder balls 27 extend below the bottom surfaces of the corners 20 and the midsections 22, the solder balls 27 are the only components of the socket assembly 10 that directly abut a motherboard 46 (as discussed below) when the socket assembly 10 is initially positioned on the motherboard 46.

Figure 11:
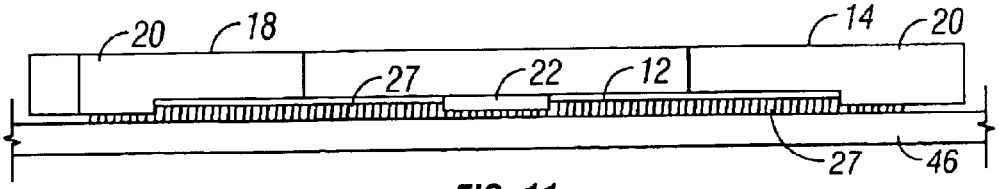
FIG. 11 is a side view of a socket assembly mounted on a motherboard before the reflow solder process, according to an embodiment of the present invention.

FIG. 11 is a side view of the socket assembly 10 mounted on a motherboard 46 before the solder reflow process. Before the solder reflow process (i.e., heating of the solder balls 27), the only portion of the socket assembly 10 that touches the motherboard 46 is the solder balls 27. The socket frame 14 does not touch, and is spaced a distance from, the motherboard 46. As shown in more detail in FIG. 13, the clearance area 36 is formed between the socket board 12 and the socket frame 14. Also, a clearance area 37 exists between the corners 20 (and midsections 22, although not shown with respect to FIG. 13) and the motherboard 46.

As solder balls are heated, such as solder balls 27, they melt to a natural height or level if there is no interfering or intervening components between the solder balls and the component to which they are being reflow soldered, such as the motherboard 46. The natural height or level of solder reflow, that is, the natural height or level to which the solder balls melt, is determined by the physical properties of the solder balls. During the solder reflow process, the solder balls 27 are allowed to reflow naturally without any interfering structure, such as the corners 20 and midsections 22, touching the motherboard 46. Hence, the corners 20 and midsections 22 do not dictate the distance of the socket board 12 from the motherboard 46. The distance between the socket board 12 and the motherboard after the reflow process is dictated by the natural height ($H_N$) of the molten solder balls 27.

Figure 12:
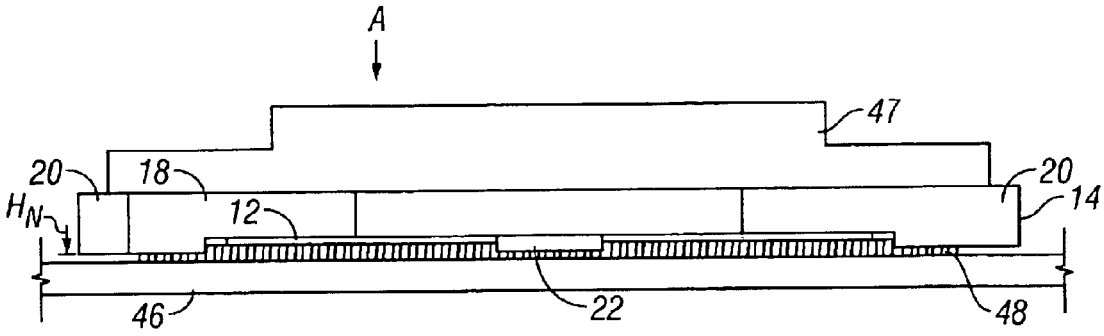
FIG. 12 is a side view of a plug assembly mated into a socket assembly according to an embodiment of the present invention.

FIG. 12 is a side view of a plug assembly 47 mated into the socket assembly 10 after the solder reflow process is complete and the reflown solder balls 27 form solder connections 48 between the socket assembly 10 and the motherboard 46. The height of the solder connections 48 is the natural height of the reflown solder balls ($H_N$). The plug assembly 47, or integrated circuit (IC) chip, mates with the socket assembly 10 in the direction of line A. The plug assembly 47 includes contacts, such as conductive pads (not shown), which mate with the spring contacts 16 positioned on the socket board 12. The spring contacts 16 are deflected by the plug assembly 47 and wipe across the contacts of the plug assembly 47. As the plug assembly 47 is mated into the socket assembly 10, the mating force in the direction of line A causes the posts 26 to move further into the post cavities 34 (in the direction of line A), as discussed above with respect to FIG. 8. That is, the mating or clamping force of the plug assembly 47 into the socket assembly 10 causes the socket frame 14 to slide or otherwise move toward the socket board 12 by way of the posts 26 sliding through the post cavities 34. The socket frame 14 is a moving frame in that it moves with respect to the socket board 12.

Figure 14:
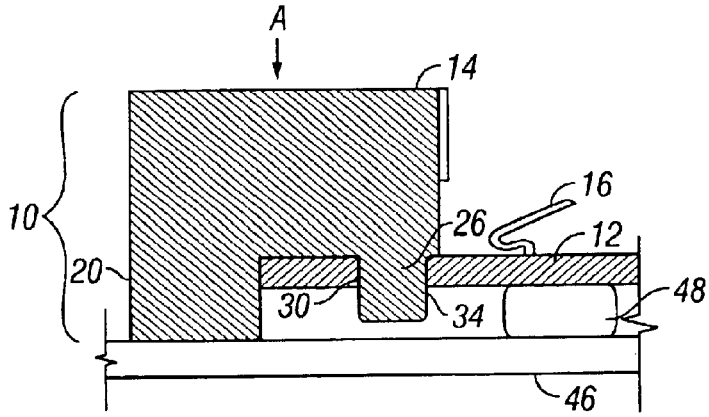
FIG. 14 is a partial cross sectional view of a socket assembly in a fully seated position according to an embodiment of the present invention.

Upon full mating of the plug assembly 47 into the socket assembly 10, the socket frame 14 may touch the motherboard 46, as shown with respect to FIG. 14. That is, as the plug assembly 47 is mated into the socket assembly 10, the movement of the plug assembly 47 in the direction of line A causes the socket frame 14 to move (by way of the interaction of the posts 26 through the post cavities 34) toward the motherboard 46. Preferably, the socket frame 14 touches or abuts the motherboard 46 at the end of the mating process. In doing so, the excess clamping or mating force when joining the plug assembly 47 and the socket assembly 10 is translated into the socket frame 14. Because the socket frame 14 touches the motherboard 46, the excess mating or clamping force is translated directly to the motherboard 46, but not through the solder connections 48. Further, an accurate connection between the plug assembly 47 and the socket assembly 10 may be ensured if the socket frame 14 contacts the motherboard during the plug assembly/socket assembly mating process. That is, the corners 20 and midsections 22 may ensure that the mating surface of the plug assembly 47 is approximately parallel to the spring tips 38 of the socket assembly 10 (due to the bottom surfaces of the standoffs 20 and 22 being in parallel contact with the top surface of the motherboard 46). In any event, the natural reflow height of the solder balls 27 is not disturbed during the reflow process or the plug assembly 47/socket assembly 10 mating process.

Figure 13:
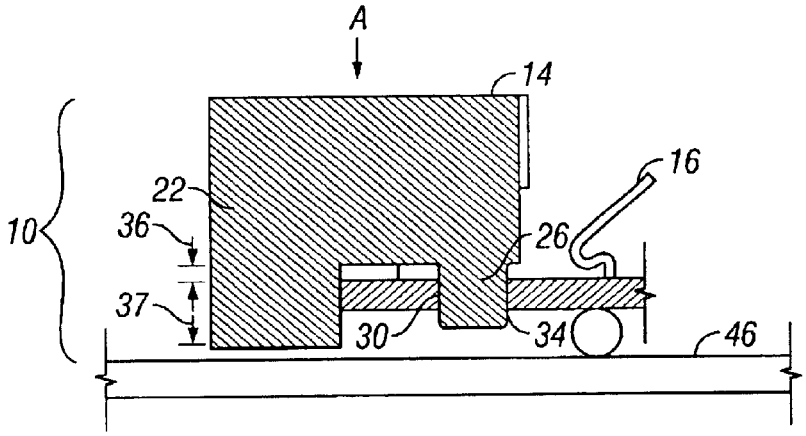
FIG. 13 is a partial cross-sectional view of a socket assembly in a pre-soldered position according to an embodiment of the present invention.

FIG. 14 is a partial cross sectional view of a socket assembly 10 in a fully seated position. For the sake of clarity, the plug assembly 47 is not shown. However, the spring contact 16 is shown in a fully deflected position. In this view, the plug assembly 47, while not shown, is in a fully mated position with respect to the socket assembly 10. Further, the socket frame 14 is fully seated with respect to the socket board 12 and the motherboard 46. It is to be noted that while the corners 20 (and midsections 22, although not shown with respect to FIG. 14) abut the motherboard 46, the corners 20 and midsections 22 do not abut the motherboard 46 during the reflow solder process. Only when the plug assembly 47 is fully seated into the socket assembly 10 does the socket frame 14 contact the motherboard 46. That is, the mating force of the plug assembly 47 into the socket assembly 10 causes the posts 26 to slide through the post cavities 34, and therefore the corners 20 and midsections 22 of the socket assembly 10 contact the motherboard 46. Also, the clearance area 36 shown with respect to FIGS. 8 and 13 is eliminated or decreased when the socket assembly 10 is fully seated. Preferably, the socket frame 14 abuts the motherboard 46 before the plug assembly 47 is fully clamped into the socket assembly 10, so that the motherboard 46 will absorb most, if not all, of the excess mating force.

As mentioned above, more or less posts 26 and post cavities 34 may be used with the socket assembly 10. Additionally, the shape of the socket frame 14 and socket board 12 may be different shapes, as long as both fit together. Additionally, the posts 26 may be any shape that interferingly fits into the post cavities 34. Further, the post cavities 34 may be any shape that interferingly engages the posts 34. Also, the posts may be positioned on, and extending upward from, the socket board 12, while the cavities, or holes, are formed within the perimeter walls of the socket frame 14.

Figure 15:
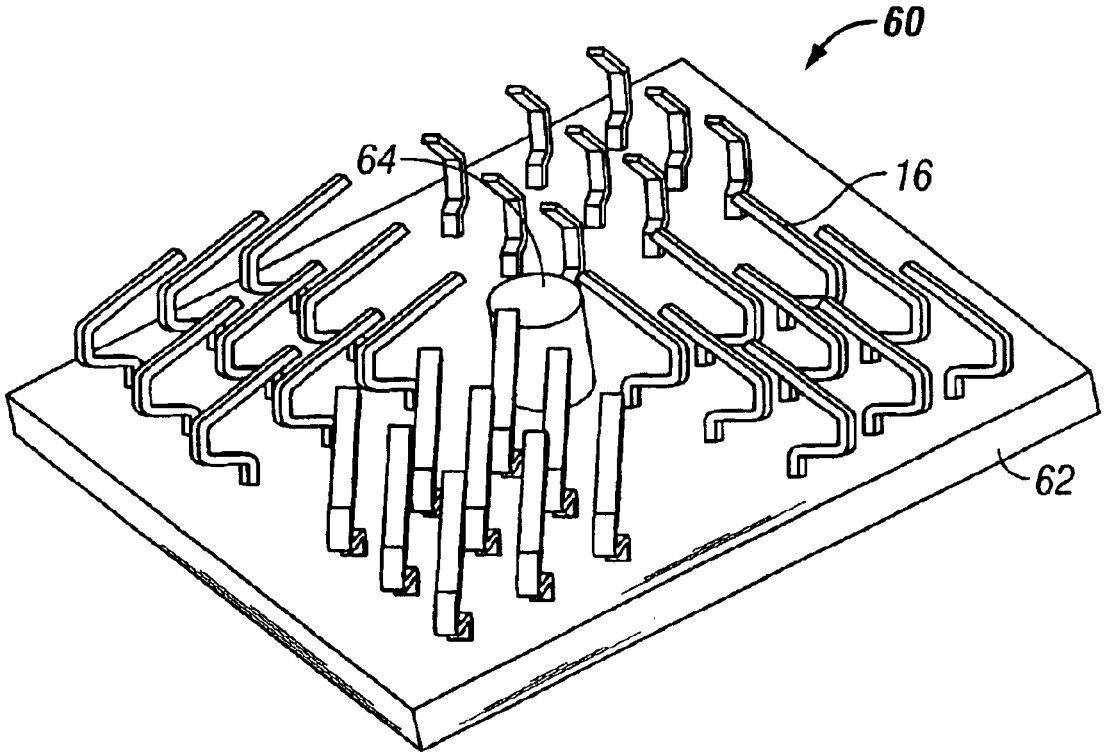
FIG. 15 is an isometric view of a socket board according to an alternative embodiment of the present invention.

FIG. 15 is an isometric view of a socket board 60 according to an alternative embodiment of the present invention. The socket board 60 includes a base 62 having spring contacts 16 mounted thereon and a post 64 upwardly extending from the base 62. The post 64 is configured to be slidably received by a corresponding hole in the plug assembly. Thus, instead of having a perimeter frame having posts, the socket board 60 includes the post 64, over which the plug assembly may slide down into a fully seated position. Alternatively, the socket board 60 may include multiple posts 64 upwardly extending from various locations on the base 62. For example, the posts 64 may be located in the corners.

Thus, embodiments of the present invention provide a socket assembly that may be reflow soldered to a motherboard more efficiently. Because the resulting solder layer is reflown to its natural height, a more reliable electrical conductive path results. Also, when a plug assembly (such as an IC chip) is mated into the socket assembly, the excess clamping or mating force is translated into the motherboard. Thus, the solder layer is not excessively stressed during the mating process.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A socket assembly configured to be reflow soldered to a circuit board, comprising:

a socket frame having a central open area surrounded by perimeter walls, wherein at least one of said perimeter walls includes a post extending downward therefrom;

a socket board fit into said open area of said socket frame, said socket board having a post hole therein positioned to mate with said post;

contacts held by said socket board; and solder balls provided on a bottom of said socket board, said solder balls engaging said contacts and, prior to soldering, extending beyond a bottom surface of said socket frame;

wherein said post is held partially seated in said post hole when said socket board and frame are positioned in a pre-soldered state, said post becoming fully seated in said post hole when said socket board and frame move together when a plug assembly is mated into said socket assembly.

2. The socket assembly of claim 1, wherein a solder layer, formed from said solder balls, extends beyond said bottom surface of said socket frame after reflow soldering.

3. The socket assembly of claim 1, wherein said socket frame is one of separate and distinct from said socket board and integrally formed with said socket board and configured to separate from said socket board upon assembly.

4. The socket assembly of claim 1, wherein prior to reflow soldering, said socket frame is above said socket board so as to form a gap between mating surfaces of said socket board and frame.

5. The socket assembly of claim 1, wherein said socket board is fully seated with and rests on said socket frame after reflow soldering and when said socket assembly is mated to a plug assembly.

6. The socket assembly of claim 1, wherein said socket frame and board are configured to contact a motherboard only through a solder layer formed by said solder balls before and after a solder reflow process.

7. The socket assembly of claim 1, wherein a clearance area is formed between said socket frame and said socket board when said socket frame is initially connected to said socket board, said clearance area decreasing when a plug assembly is mated with said socket assembly.

8. The socket assembly of claim 1, wherein said contacts comprise spring contacts extending from a top surface of said socket board, said spring contacts comprising wiping tips formed integrally with deflectable extension portions, said deflectable extension portions being integrally formed with curved transition portions.

9. A socket assembly comprising:

a base holding a plurality of spring contacts extending outwardly from a plug mating side of said base;

a plurality of solder balls extending outwardly from a board mating side of said base;

a perimeter frame that is separate and distinct from said base, said perimeter frame being moveable relative to said base along a plug mating direction when said base is connected to said perimeter frame; and a clearance area formed between said perimeter frame and said base when said perimeter frame is initially connected to said base, wherein said clearance area is decreased when a plug assembly is mated with said socket assembly after a solder reflow process.

10. The socket assembly of claim 9, wherein said perimeter frame comprises a plurality of posts that mate with a corresponding number of holes formed in said base, said posts moving within said holes between partially and fully seated positions as a plug connector is joined with said base and said perimeter frame.

11. The socket assembly of claim 9, wherein said solder balls extend beyond a bottom surface of said perimeter frame when said perimeter frame is connected to said base.

12. The socket assembly of claim 9, wherein said socket assembly is configured to be positioned on a circuit board prior to a solder reflow process, said socket assembly contacting the circuit board only through said solder balls prior to and after the solder reflow process.

13. The socket assembly of claim 9, wherein said perimeter frame is configured to move toward said base when a plug assembly is mated into said socket assembly.

14. The socket assembly of claim 9, wherein each of said plurality of spring contacts comprises a wiping tip formed integrally with a deflectable extension portion, said deflectable extension portion being integrally formed with a curved transition portion.

15. A socket assembly configured to be reflow soldered to a circuit board, comprising:

a base having a plurality of spring contacts extending outwardly from a plug mating side of said base;

a plurality of solder balls extending outwardly from a circuit board mating side of said base, said base being configured to contact a circuit board only through said solder balls prior to and after a solder reflow process; and a perimeter frame that is separate and distinct from said base and postionable to engage a plug assembly, said perimeter frame being moveable relative to said base along a plug mating direction when said base is connected to said perimeter frame, said perimeter frame comprising a plurality of posts that mate with a corresponding number of holes formed in said base, said posts positionable relative to said holes in a first position after soldering said base to said circuit board and a second position after said socket assembly is mated to said plug assembly.

16. The socket assembly of claim 15, wherein said posts are held partially seated in said holes when said base and perimeter frame are positioned in a pre-soldered state, said posts becoming fully seated in said holes when said base and perimeter frame move to a fully mated state when a plug assembly is mated into said socket assembly.

17. The socket assembly of claim 15, wherein said solder balls, prior to reflow soldering, support said base, and wherein said perimeter frame is above said base to form a gap between mating surfaces of said base and perimeter frame.

18. The socket assembly of claim 15, wherein after reflow soldering and plug assembly mating, said perimeter frame is fully seated with and rests on the circuit board.

19. A socket assembly comprising:

a base holding a plurality of spring contacts extending outwardly from a plug mating side of said base;

a plurality of solder balls extending outwardly from a board mating side of said base; and a perimeter frame that is separate and distinct from said base, said perimeter frame comprising at least one post being slidably positionable relative to said base after a solder reflow process, thereby permitting movement of said post when a plug assembly is mated to said socket assembly such that a natural reflow height of said solder balls is not disturbed.

20. A socket assembly configured to be reflow soldered to a circuit board comprising:

a base holding a plurality of spring contacts extending outwardly from a plug mating side of said base;

a plurality of solder balls extending outwardly from a board mating side of said base; and a perimeter frame that is separate and distinct from said base, said perimeter frame comprising at least one post being slidably received in a hole formed in said base, said post being positionable relative to said base within said hole after said solder balls are reflowed, whereby when a plug assembly is mated to said socket assembly, excess clamping forces are transmitted from said frame to said circuit board without affecting the reflowed solder balls.

* * * * *